US010240424B2

(12) United States Patent
Brown

(10) Patent No.: US 10,240,424 B2
(45) Date of Patent: Mar. 26, 2019

(54) CHRISTMAS TREE

(71) Applicant: Stuart Brown, Huntly (GB)

(72) Inventor: Stuart Brown, Huntly (GB)

( * ) Notice: Subject to any disclaimer, the term of this patent is extended or adjusted under 35 U.S.C. 154(b) by 0 days.

(21) Appl. No.: 15/580,151

(22) PCT Filed: Jun. 24, 2016

(86) PCT No.: PCT/GB2016/051911
§ 371 (c)(1),
(2) Date: Dec. 6, 2017

(87) PCT Pub. No.: WO2016/207662
PCT Pub. Date: Dec. 29, 2016

(65) Prior Publication Data

US 2018/0135375 A1 May 17, 2018

(30) Foreign Application Priority Data

Jun. 25, 2015 (GB) ..... 1511225.3

(51) Int. Cl.
*E21B 33/035* (2006.01)
*E21B 34/04* (2006.01)

(52) U.S. Cl.
CPC ..... *E21B 33/035* (2013.01); *E21B 34/04* (2013.01)

(58) Field of Classification Search
CPC .... E21B 33/035; E21B 33/043; E21B 33/076; E21B 34/04; E21B 34/045
See application file for complete search history.

(56) References Cited

U.S. PATENT DOCUMENTS 5,535,826 A * 7/1996 Brown ..... E21B 34/04 166/244.1
5,971,077 A * 10/1999 Lilley ..... E21B 33/035 166/348
5,992,527 A * 11/1999 Garnham ..... E21B 34/04 166/379
6,076,605 A * 6/2000 Lilley ..... E21B 33/035 166/344

(Continued)

FOREIGN PATENT DOCUMENTS

GB 2192921 A * 1/1988 ..... E21B 33/035
GB 2286840 A 8/1995
GB 2398592 A 8/2004

OTHER PUBLICATIONS

European Patent Office as Int'l Searching Authority, International Search Report for PCT/GB2016/051911, dated Aug. 16, 2016, entire document, Rijawijk, The Netherlands.

(Continued)

*Primary Examiner* — Matthew R Buck
(74) *Attorney, Agent, or Firm* — Law Office of Jesse D. Lambert, LLC

(57) ABSTRACT

A Christmas tree and a method of completing a well in a standard wellhead. The tree is presented as separately deployable upper and lower portions with the master valves contained in the lower portion so that they are located below the wellhead housing to lower the height of the tree while increasing well safety and integrity. The upper master valve is bi-directionally sealing to allow for pressure testing, removing the requirement for tubing hanger plugs.

19 Claims, 10 Drawing Sheets

(56) References Cited

U.S. PATENT DOCUMENTS

| | | | | |
|---|---|---|---|---|
| 6,357,529 | B1 * | 3/2002 | Kent | E21B 33/035 166/344 |
| 6,823,942 | B1 | 11/2004 | McGee | |
| 7,647,974 | B2 * | 1/2010 | Fenton | E21B 33/035 166/338 |
| 8,011,436 | B2 * | 9/2011 | Christie | E21B 33/038 166/338 |
| 8,240,389 | B2 * | 8/2012 | Christie | E21B 33/047 166/368 |
| 8,881,827 | B2 * | 11/2014 | Bjerke | E21B 33/0355 166/344 |
| 2008/0245529 | A1 | 10/2008 | Christie et al. | |
| 2014/0299328 | A1 * | 10/2014 | Ray | E21B 33/035 166/358 |

OTHER PUBLICATIONS

UK Intellectual Property Office, Combined Search and Examination Report for GB1511225.3, dated Oct. 21, 2015, entire document, South Wales, United Kingdom.

* cited by examiner

CHRISTMAS TREE

The present invention relates to wellhead structures as found in oil and gas installations and more particularly, though not exclusively, the invention relates to a Christmas tree arrangement for a subsea wellhead.

When drilling a well, a wellhead will be located at the surface which may be on land or on the sea-bed. Wellhead dimensions are considered as an industry standard and determine the size of all components fitted in the well. A tubing hanger is hung off in the wellhead which provides a passage for communicating with the interior of the production tubing and another passage for communication with the annulus that surrounds the production tubing in the completion phase of the well.

In order to control the flow of fluids, typically oil and gas, out of the well, a Christmas tree is located and connected to the top of the wellhead at the surface of the well. The tree is provided with a number of valves, these typically being gate valves. The valves may be arranged in a crucifix-type pattern which gives the tree its characteristic term "Christmas tree". The valves provide a barrier between the well and the environment. There are two lower valves referred to as the upper master valve and the lower master valve. Above these on one side will sit the flow wing valve which is the main flow path for the fluids from the well. At the top of the tree is located a swab valve, the swab valve providing a path for well interventions. Where the tree is intended for subsea deployment a crossover valve is also present between the production tubing and annulus. Otherwise a kill wing wing valve may be present, on the other side from the flow wing valve and this valve is used for injecting fluid into the well. At the lower end of the tree, below ground level, the tree provides a production tubing passage that will stab into the production tubing located in the well. It will also have an annulus passage or bore which similarly stabs into the annulus in the well.

Those skilled in the art will recognize that trees may contain additional valves and accessories than those described above e.g. a choke. In particular, when the tree is a subsea tree, it will include a flow line connection interface and a subsea control interface to send and receive control and sensor data.

A major disadvantage of these trees is in their size and weight when the arrangement of valves is fitted. This is a particular disadvantage for subsea trees where, in order to accommodate all the required valves, the tree becomes of an undesirable height and weight. The height of subsea trees makes them vulnerable to damage by passing vessels and may result in trawler nets being snagged upon the fittings. Additionally, if the apparatus sits above the ground, the tree is liable to corrosion and fouling from the effects of the sea water. For trees located on platforms, there is a major disadvantage in that these trees are required to be huge mono-block forgings. This is because they are designed to increase the evacuation time from a burning platform.

Additionally, a further disadvantage for subsea trees in particular, is in the requirement for an orientation system to be used for lining up the annulus bore which is off-axis from the production bore, and thus the separate stab of the annulus bore has to be aligned correctly before stabbing. This takes precision and more importantly, a great deal of preparation time.

During the drilling of the well, it is necessary to use a blow-out preventer (BOP) to provide a barrier between the well and the environment until the Christmas tree is in place. However, while many operations can be performed through the BOP, the tree is too large to be located through the BOP. Therefore a temporary barrier must be located in the well to allow the BOP to be removed and the tree to be put in place. This temporary barrier is normally provided by a tubing hanger plug. These plugs are typically run on wireline through a production riser in the BOP and set to seal the production bore and the annulus bore in the tubing hanger. Once set, the BOP is removed and the tree is lowered and orientated to stab into the production bore and the annulus bore. Once in position, pressure tests can be made against the plugs before they are removed, by wireline through the upper and lower master valves, and the well can flow.

The running, setting, testing against, un-setting and pulling of the tubing hanger plug adds significant time to the installation of the Christmas tree. The temporary nature of the plugs also gives concerns over the effectiveness of the barrier and the safety of the well between removal of the BOP and the installation of the tree.

As safety is paramount, during later well intervention, a BOP is required to be mounted above the tree to provide an additional barrier when the intervention tool string is run through the Christmas tree into the well. Additionally, in many wells a downhole safety valve often referred to as a subsurface safety valve (SSSV) is installed. The SSSV is located below the tubing hanger in the production tubing. The SSSV is typically a ball or flapper valve which acts as a check valve and it is hydraulically operated and will close unless hydraulic fluid pressure is maintained upon it, thus, hydraulic fluid communication is required through the tree and the production tubing as far as the SSSV.

A further disadvantage is found when such intervention is required in the well and a wireline tool string is run in through a lubricator at the swab valve. The length of the tool string can be 20 to 50 feet. This is significant enough in that the tool string can straddle a BOP and all the valves within the tree, thus there is a position where the well is vulnerable with only the sub-surface safety valve providing any shut-in capability. In particular, if the tool string were to stick at any point, when straddling the BOP and the tree, the emergency disconnect cannot be used. Thus, this ability to straddle two safety systems is a major disadvantage.

An object of the present invention is to provide a Christmas tree for location at a wellhead which obviates or mitigates at least some of the disadvantages of the prior art Christmas tree.

It is a further object of at least one embodiment of the present invention to provide a method of completing a well which obviates and mitigates at least some of the disadvantages of the prior art arrangements.

According to a first aspect of the present invention there is provided a Christmas tree for location at a standard wellhead, the wellhead having a tubing hanger extending into a wellbore, the tree comprising:

an upper tree portion, including a swab valve, a flow wing valve and, at a lower end, first connection means for connecting the upper tree portion in the wellhead;

a lower tree portion, including at least one master valve and second connection means for locking the lower tree portion to an inner surface of the wellbore, wherein:

the at least one master valve is a bi-directionally sealing valve and the at least one master valve is located below the tubing hanger.

In this way, the Christmas tree is provided as a split tree arrangement, where the lower tree portion can be located in or below the wellhead housing, and the upper tree portion at the wellhead. By arranging the master valves to be located below the wellhead housing and tubing hanger, in the well, the lower tree portion can be inserted through the BOP and be used to seal the well while the BOP is removed and the upper tree portion put in its place. This can all be achieved using a standard wellhead. Additionally, by providing a master valve which is bi-directionally sealing, it can be pressured up from above so that pressure testing against the master valve can be achieved. This entirely removes the requirement for tubing hanger plugs. Further, only the upper tree portion is above the surface and thus a low-profile tree is provided. This reduction in the overall height at the wellhead provides advantages in a smaller lighter weight construction due to the reduced volume with reduced possibility of snagging in subsea wells.

A downhole safety valve may be installed below the lower tree portion. The downhole safety valve may be referred to as a subsurface safety valve (SSSV) as is known in the art and installed in the production tubing. As the SSSV is standard and can be operated via a hydraulic fluid line, hydraulic fluid communication can be delivered to the master valve(s) if desired.

Preferably, the lower tree portion is arranged such that a distance between the swab valve and an upper master valve is greater than a length of an intervention tool string. An intervention tool string is a tool string hung from wireline and typically has a length between 10 and 100 (usually less than 50 ft) feet. In this way, the lower tree portion can be positioned lower down in the well if required, providing additional safety, hydrate prevention or preferred intervention safety as the intervention tool string cannot straddle the swab valve and the upper master valve. Thus, with a tool string in the well, there are always two safety systems in place.

Preferably, where a BOP is located above the upper tree portion, such as for intervention, the lower tree portion is arranged such that a distance between the BOP and an upper master valve is greater than a length of an intervention tool string. In this way, the intervention tool string cannot straddle the BOP, swab valve and the upper master valve. Thus, with a tool string in the well, there are always two safety systems in place.

Preferably the upper tree portion includes, at a lower end, first engaging means for connecting the upper tree portion to a second engaging means located in the wellbore and the lower tree portion includes, at an upper end, the second engaging means for connection to the upper tree portion. In this way, the upper and lower tree portions can be physically connected. The alternative is for each to be independently attached to surfaces in the wellbore with a section of casing joining the upper tree portion to the lower tree portion.

Preferably, the first engaging means is a concentric stab and the second engaging means is a concentric seal bore. In this way the concentric stab connects with the concentric seal bore to make a physical connection between the upper and lower tree portions. By providing a concentric stab and a concentric seal bore, the upper tree portion does not require to be orientated when landing on the wellhead. Additionally, a running tool including a concentric stab can be used to install the lower tree portion into the wellbore.

Preferably, the first connection means is part of a standard wellhead connector as is known in the art. In this way, the upper tree portion can be locked into a standard wellhead connector of the standard wellhead without requiring modification to the wellhead.

Preferably, the second connection means includes a connection interface to couple the upper and lower tree portions by one or more coupling means selected from a group comprising: mechanical, hydraulic, electrical, electro-hydraulic, optical and inductive.

In this way, the electrical power control signals and monitoring signals can be passed between the upper and lower tree portions and between the lower tree portion and any upper device which includes coupling means into the concentric seal bore.

Preferably, the bidirectional sealing valve is controlled from the upper tree portion. This allows the master valves to be operated from the control module located outside the wellbore and thus, pressure testing via the master valves can be achieved. Alternatively, a control module may be located in the lower tree portion. This allows autonomous control of the master valves together with other components. This can reduce the amount of connections i.e. electro hydraulic/optical etc going through the stab and connected to surface.

Additionally, one or more master valves may be designed to be wireline or coil tubing cutting. In this way, the master valve can be used as an emergency shear if an intervention deployed tool string where to stick in a location below the master valves, possibly across the SSSV preventing it's operation.

Preferably, the coupling means is orientationless. In this, we mean that, there is no requirement for a rotational alignment between the concentric stab and the concentric seal bore when coupled together. Those in the art will appreciate that such coupling systems in the form of galleried arrangements with radial seals and annulus flow paths, can be formed in the coupling.

Preferably, the swab valve is selected from a group comprising a crown plug, a gate valve, a plug valve and a ball valve. Each of these merely provides the environmental and pressure isolation at the upper tree portion as is known in the art.

Preferably, the concentric seal bore is located in the wellhead. In this way, the concentric stab from the upper tree portion is not excessively long and does not need orientation into the axial wellbore and a concentric seal bore.

Advantageously, the second connection means includes a hanger. In this way, the lower tree portion can be considered as a split tree hung from the tubing hanger. This provides a standard deployment in the wellbore.

Alternatively, a landing shoulder may be provided on the casing string and the second connection means is landed on the landing shoulder. In this way, the lower tree portion can be provided on a completely independent hanger system which is not reliant on the wellhead.

Optionally, the second connection means comprises a packer and the lower tree portion is set within the casing string. In this way, further known connection means can be used to locate the lower tree portion at a desired location in the casing string by known technology means.

In this way, the user can select the depth for the master valve(s) to be located in the wellbore by simply determining the length of tubing in the lower tree portion between the hang off point and the required depth. The increased depth further isolates the master valve(s) to improve safety.

The upper tree portion may include one or more additional components selected from a group comprising: a control module, a choke system, annulus valves, crossover valves, chemical injection packages and booster pumps. Such additional components and the like are known in the art. Additionally a debris cover may be located over the upper tree portion. Such a debris cover may be provided by a simple ROV installation and thus, the Christmas tree finds application at any subsea installation.

Advantageously, a guidebase convertor is positioned on a permanent guidebase at the wellhead. The guidebase converter will comprise a frame with a plurality of hubs, each hub including means for connecting umbilicals selected from a group comprising: at least a flow line and a control bundle to upper tree portion connectors, and fixing means for locating the guidebase converter to guide posts of the permanent guidebase. This advantageously provides two options in that the upper tree portion can be run after the guidebase converter is in position, or may be connected to the guidebase convertor at surface and run together. When intervention is required we can choose to remove only the upper tree portion to leave the hubs in place.

Advantageously, this common interface means that only one tool is required to change out a whole package and everything gets renewed in one operation. Booster pumps, chemical injection packages etc can all be easily changed as they are pre-installed to the upper package. Higher reliability is also achieved from permanent onshore plumbing.

According to a second aspect of the present invention, there is a method for completing a well comprising the steps:

a) providing a Christmas tree according to the first aspect:

b) providing a workstring, the workstring including a running stab at a lower end thereof;

c) locating the running stab in the lower tree portion;

d) running the lower tree portion into the well through a BOP;

e) attaching the lower tree portion to an inner surface of the wellbore;

f) pressure testing against a master valve in the lower tree portion to determine well safety;

g) pulling the workstring and the BOP; and g) landing the upper tree portion on the wellhead.

In this way, a well can be completed using a Christmas tree which provides the low profile which advantageously has a simplified construction for a subsea wellhead which will reduce snag trawler nets and reduce costs of expensive protection structures. Additionally, locating the valves lower in the well provides a smaller exposed tree portion at the wellhead and thus, reduces the possibilities of corrosion and bending damage to the structure. Further advantages are determined using the tree in platforms and land wells. The method of the present invention reduces the need for hanger isolation plugs and indeed eliminates them. In particular, platform trees are currently huge mono block forgings designed to increase evacuation time from a burning platform, such forgings are now no longer required as the valves are located lower in the well increasing evacuation time from a burning platform and also providing a space-saving on the platform reducing the costs of such platform constructions.

Preferably the method includes the step of stabbing a lower end of the upper tree portion into a concentric sealing bore at an upper end of the lower tree portion. In this way, the upper and lower tree portions are directly connected.

Preferably, the method includes the step of closing the upper and lower master valves prior to step d). In this way, the master valves can be controlled from surface via the workstring. Optionally, the method may include the step of providing two additional valves in the workstring. In this way, a further two safety valves are available in the workstring if required.

Preferably, the method includes the step of locating a SSSV in the production tubing below the lower tree portion. More preferably, the method includes the step of selecting a length of the lower tree portion such that a distance between the swab valve and an upper master valve is greater than a length of an intervention tool string. In this way the master valves are located a significant distance below the wellhead housing.

In an embodiment of the present invention, the method includes the further step of performing well intervention. This may be achieved by locating an intervention BOP on the upper tree portion as is standard in the art, running an intervention tool string through the intervention BOP, the upper tree portion and the master valves in the lower tree portion to perform the desired well intervention. In this way, the intervention tool string cannot straddle both the BOP and the master valves due to the separation between the swab valve and the master valve, thus the system always provides a safety feature and prevents the possibility of loss of a barrier if the intervention tool string ever sticks when being run through either of the safety barriers. Additionally, the method may include the step of cutting the wireline or coil tubing by use of a cutter valve as one of the master valves, or as a separate valve. This provides a further safety feature in the event of the intervention tool string sticking.

The Christmas tree of the present invention may also be used to monitor the 'B' annulus by providing a port through the casing string below the wellhead.

Advantageously, the method includes the step of operating the one or more valves, in particular, the master valves by electrical means. The introduction of an electrical means at the lower tree portion can reduce the size of components and increase the functionality, providing the opportunity to have a control module located in the lower tree portion.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

Embodiments of the present invention will now be described, by way of example only, with reference to the accompanying drawings of which:

Figure 8:
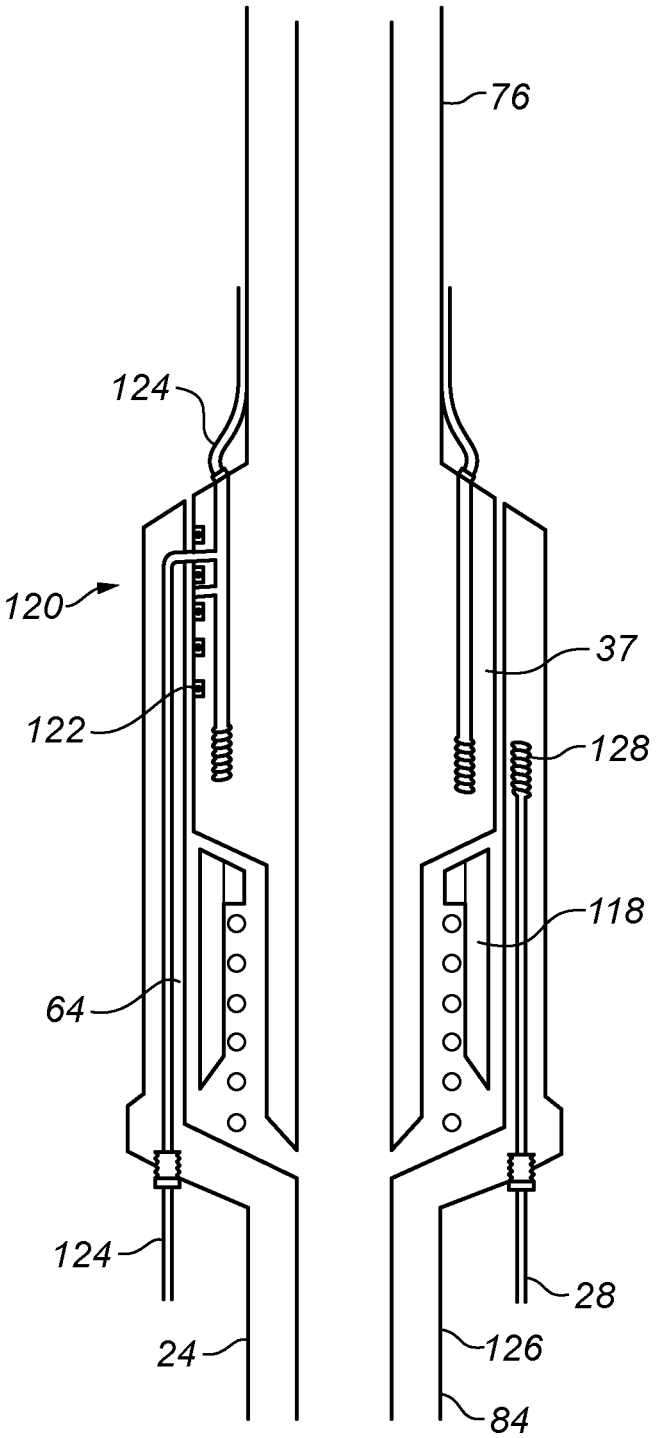
Figure 9:
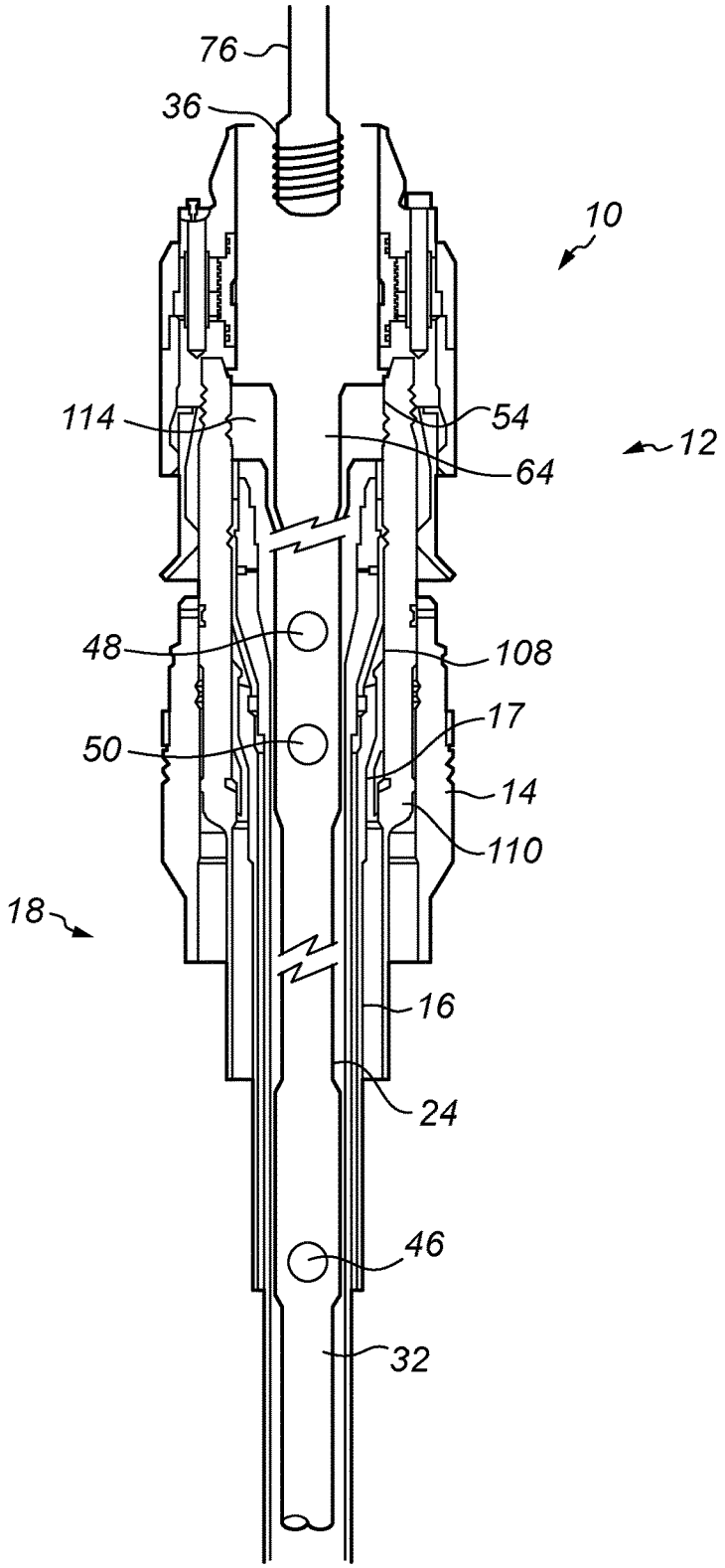
Figure 10:
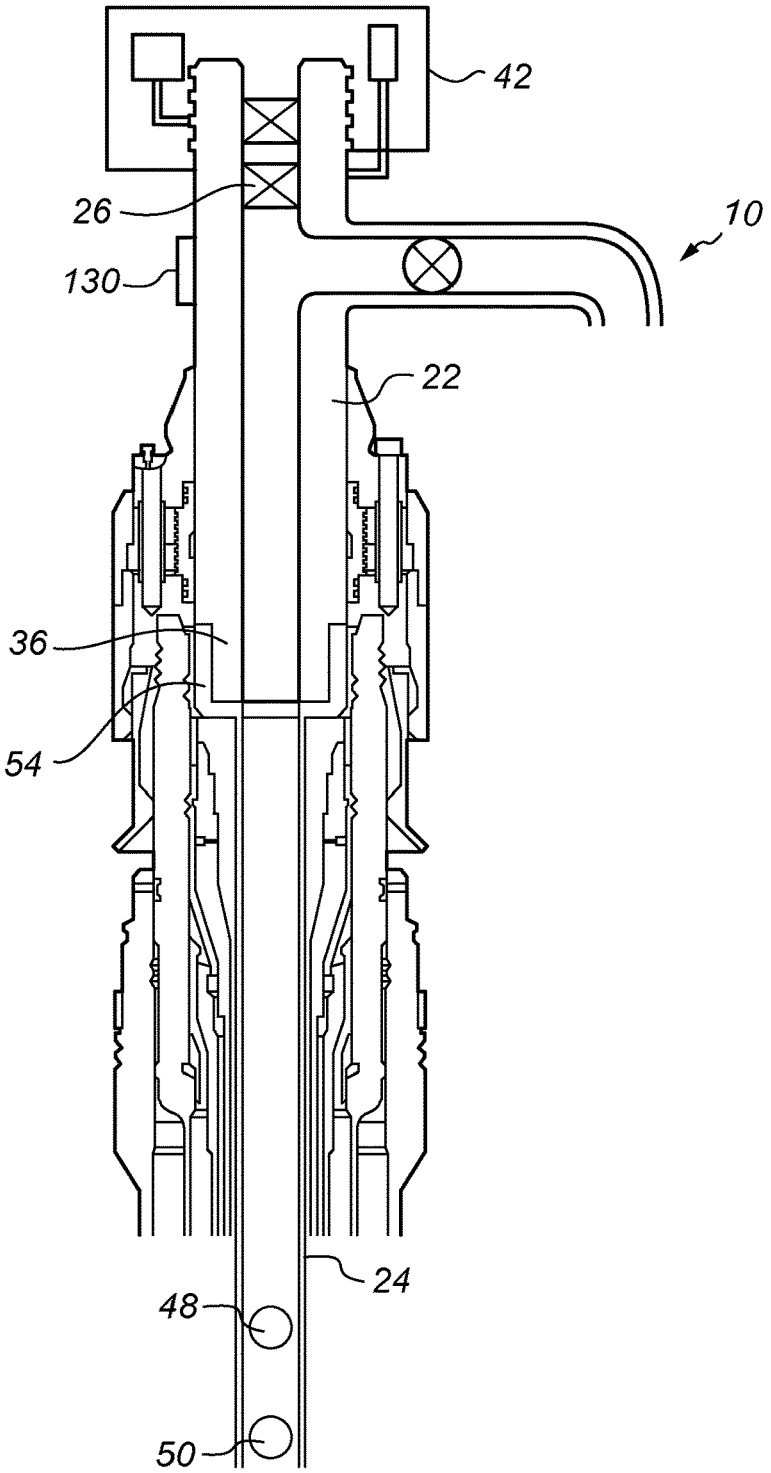
Figure 11:
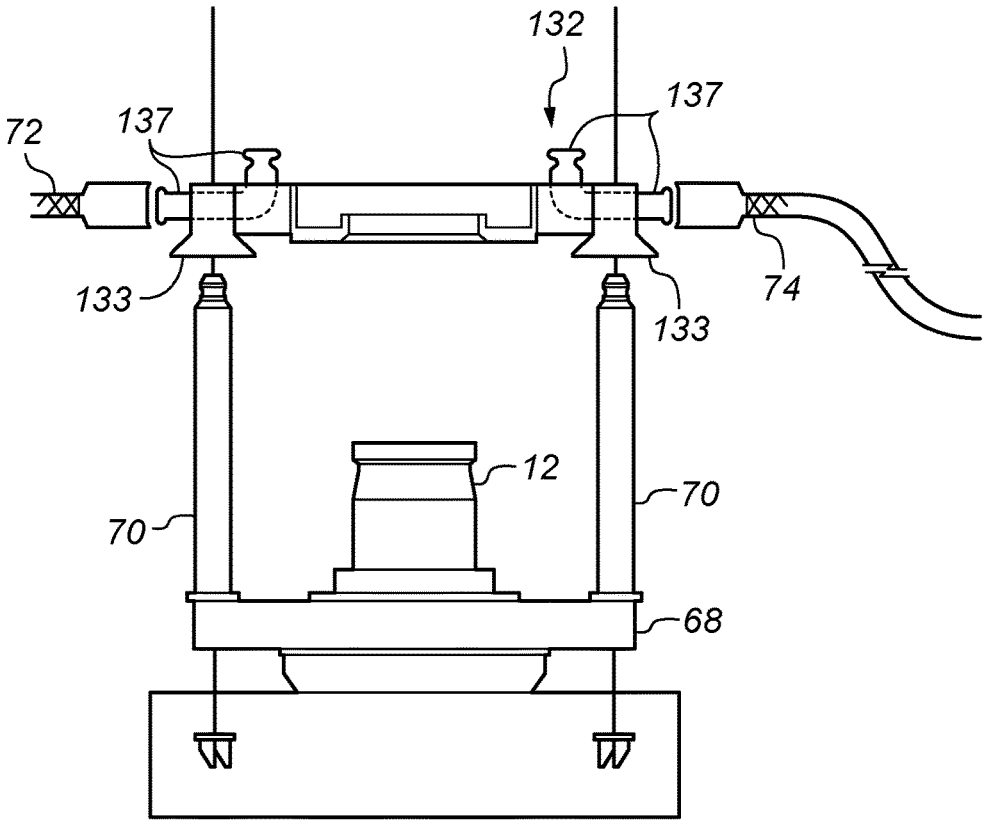
Figures 12A, 12B:
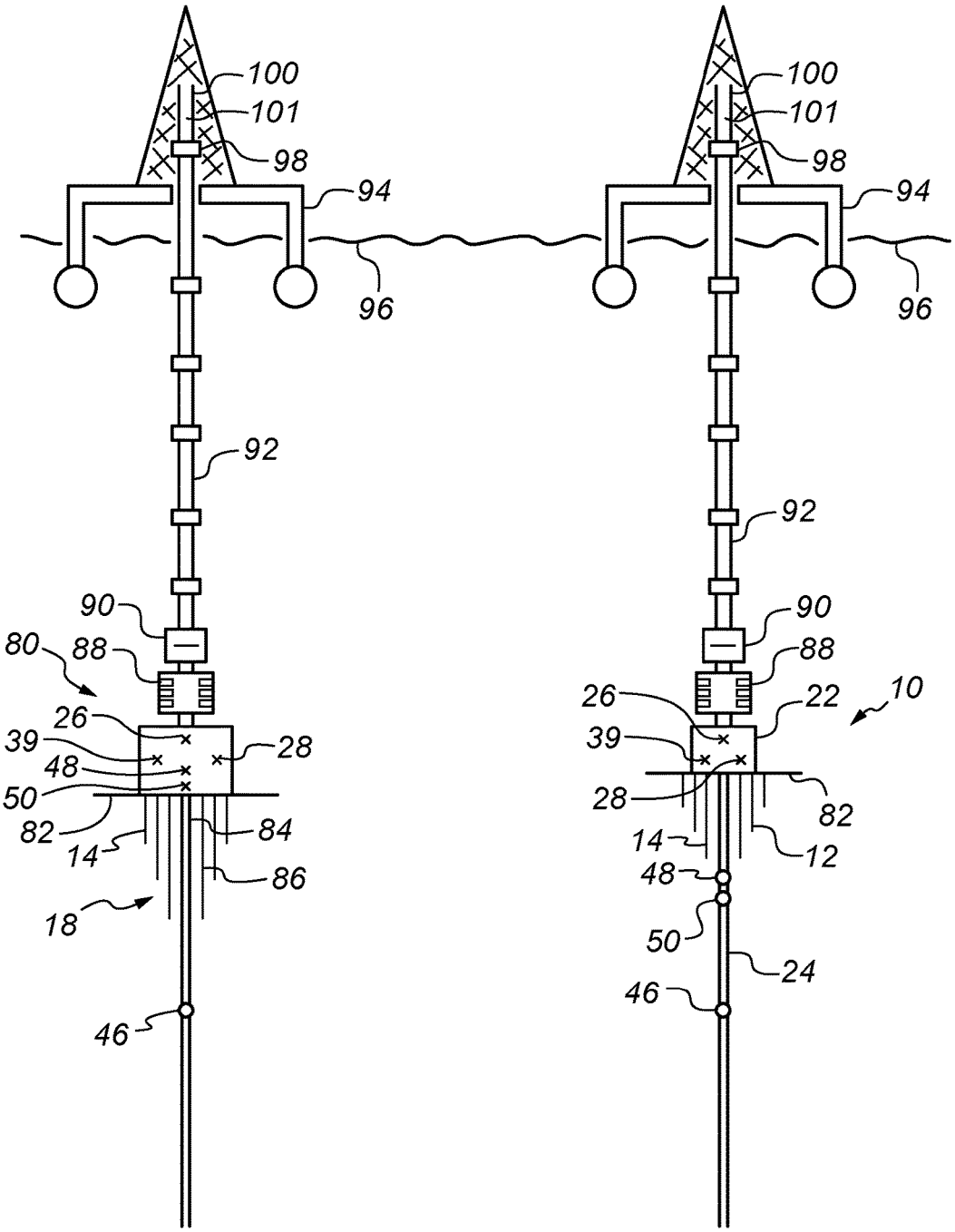
Figure 13A:
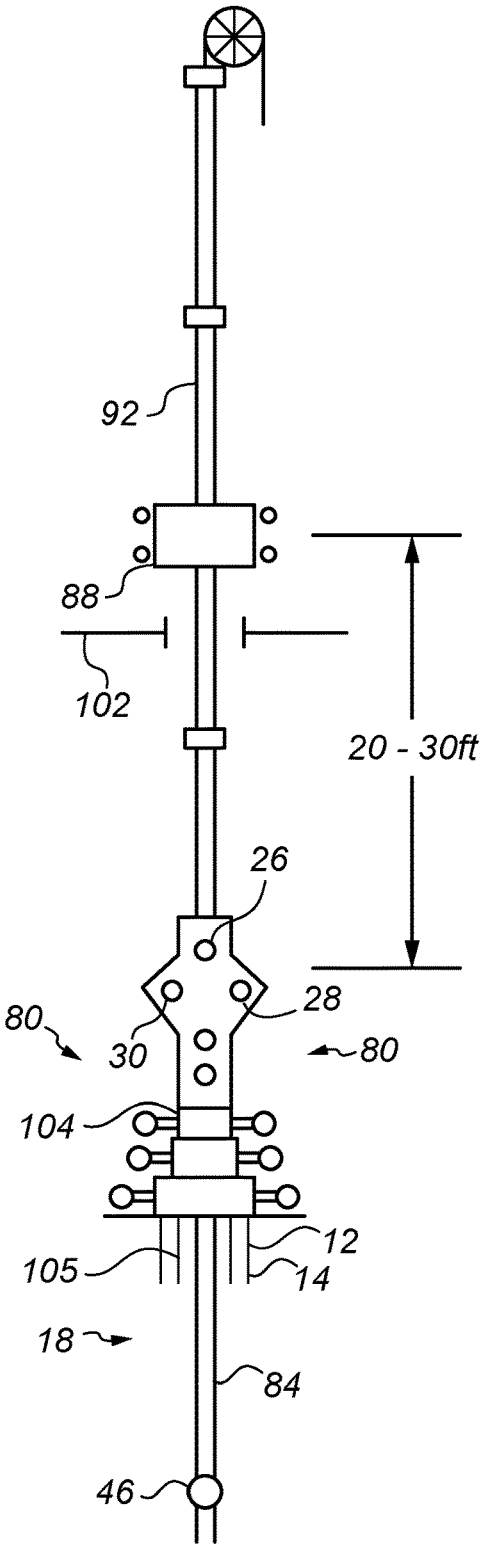
Figure 13B:
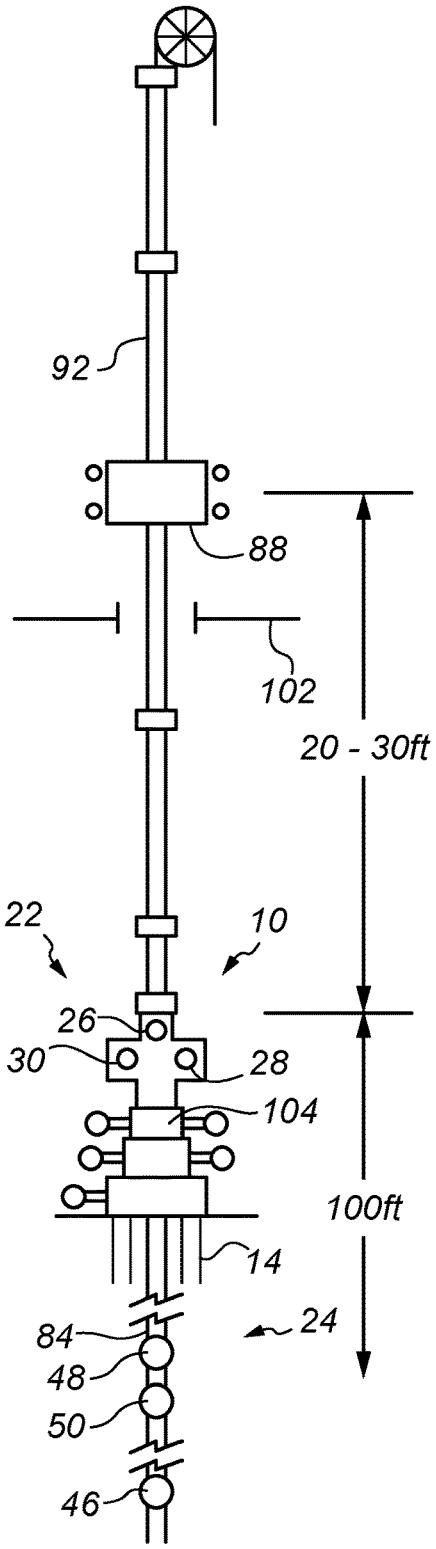
Figure 14A:
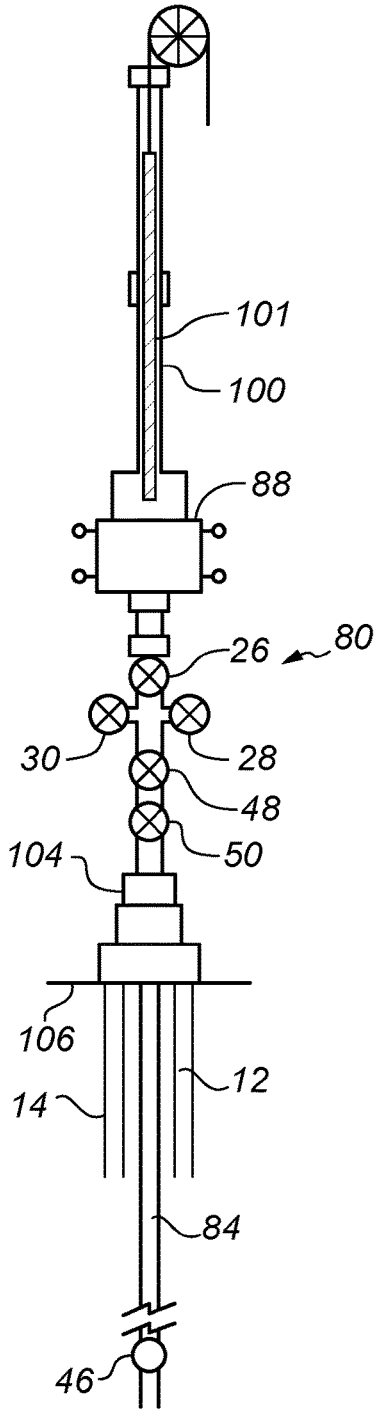
Figure 14B:
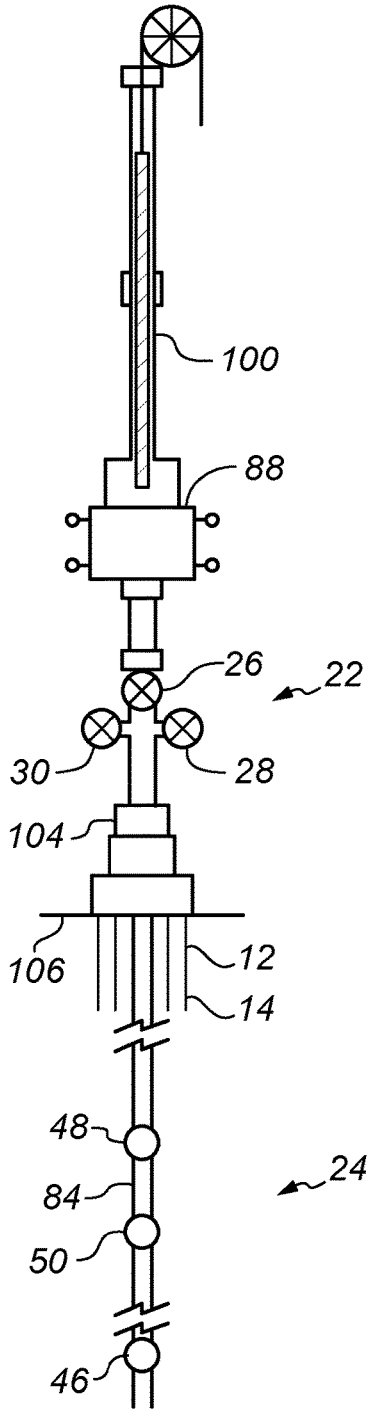

FIGS. 7(*a*) to 7(*f*) are a sequence of schematic illustrations showing the installation steps of a Christmas tree according to the present invention for a well completion;

FIG. 8 illustrates the connection between a running string and a lower tree portion of a Christmas tree, according to an embodiment of the present invention;

FIG. 9 is a schematic cross-sectional illustration of the lower tree portion of the Christmas tree of FIG. 8 in a wellbore;

FIG. 10 illustrates the upper tree portion and the lower tree portion of the Christmas tree of FIG. 8 in a completed well;

FIG. 11 is a schematic illustration of a guidebase converter as provided with the Christmas tree according to an embodiment of the present invention;

FIG. 12(*a*) illustrates a subsea well configuration including a conventional subsea tree as per the prior art and FIG. 12(*b*) illustrates the same subsea well development in which a Christmas tree according to the present invention is included;

FIG. 13(*a*) is a schematic illustration of a Christmas tree arrangement for a platform-style hook-up as is known in the prior art and FIG. 13(*b*) shows the same hook-up procedure with the Christmas tree of the present invention; and FIG. 14(*a*) illustrates a Christmas tree arrangement at the wellhead of a land well as is known in the art and FIG. 14(*b*) shows the same land well arrangement with the Christmas tree of the present invention.

Figure 1:
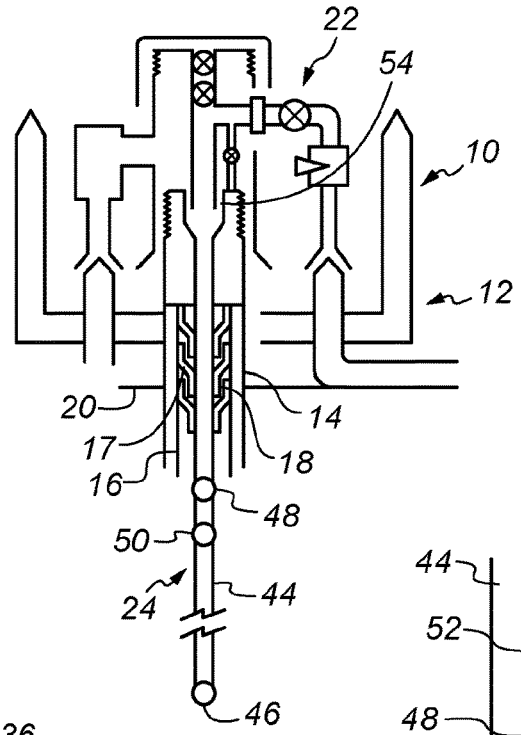
FIG. 1 is a schematic illustration of a Christmas tree located at a wellhead according to an embodiment of the present invention.

Reference is initially made to FIG. 1 of the drawings which illustrates a Christmas tree, generally indicated by reference numeral 10, at a wellhead 12 according to an embodiment of the present invention.

Wellhead 12 comprises a wellhead housing 14 from which is hung a casing string 16, from a tubing hanger 17, as is known in the art. Casing string 16 extends through the wellbore 18 and the wellhead 12 is located at ground level (seabed level) 20.

Figure 2:
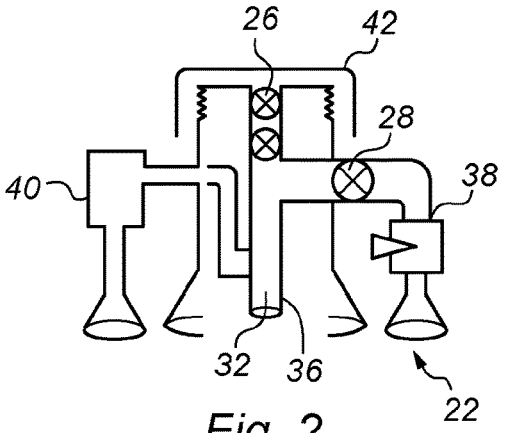
FIG. 2 is a schematic illustration of the upper tree portion of the Christmas tree of FIG. 1.

Christmas tree 10 comprises an upper tree portion 22 and a lower tree portion 24. The upper tree portion 22, as indicated in FIG. 2, includes the standard components of the swab valve 26 and a flow wing valve 28. Swab valve 26 resides at the higher-most point of the upper tree portion 22 in the main tubing 32. The main tubing 32 has at a lower portion, a concentric stab 36 which will be described more fully hereinafter. Other known components such as the choke 38, a control module 40 and a debris cap 42 are also located at the upper tree portion 22. The valves 26, 28 of the upper tree portion 22 are typically gate valves many of which are typically hydraulically operated as are known in the art. In the present invention, the possibility of these being ball valves is also included. It will be appreciated that the swab valve 26 may also be replaced by an isolation plug or crown plug as is known in the art to provide environmental and pressure isolation. Additionally, booster pumps, chemical injection packages, gas lift packages and other production support packages may also be incorporated as are known in the art.

In the present invention the control module 40 and the choke system 38 are permanently plugged into the upper tree portion 22. The upper tree portion 22 has a low profile which advantageously allows use of the Christmas tree 10 in subsea wells where it will reduce interference or snag on trawler nets. The debris cover 42 can simply be placed over the upper tree portion 22 by an ROV and such ROV use can be made to actuate the valves 26, 28 by use of a torque multiplier.

The concentric stab 36 can be considered as an engaging means and forms a connection to the lower tree portion 24. The concentric stab 36 is pre-prepared with hydraulic power, electrical power, electrical signal, optical signal or a combination of these in order to control downhole functions in the wellbore 18. These are driven from the control module 40. Normal tree functionality is also contained in the upper tree portion 22 as will be recognized by those skilled in the art, with the functions of pressure monitoring annulus bleed-off, chemical injection etc.

The lower tree portion 24 comprises a tubing 44 in which is located a sub-surface safety valve (SSSV) 46 as is known in the art. Located higher in the tubing 44 of lower tree portion 24, above the SSSV, are the master valves 48, 50 these being recognized as the upper master valve 48 and the lower master valve 50. These valves 46, 48, 50 are electrically or hydraulically operated via control lines 52 arranged on the tubing 44. At least the upper master valve 48 is a ball valve or similar. This ball valve operates as a plug valve but also can be arranged to allow the passage of tool strings through the valve. Those skilled in the art will realise that various designs of valve are possible. This upper master valve 48 will also be controlled to allow bidirectional sealing, that is, the valve 48 may be held closed so that pressure from above or below can act on the ball and prevent the passage of fluid for pressure testing purposes. This is in contrast to the typical check valve arrangement of the SSSV 46 which acts as a check valve in that it is designed to allow fluid to flow from the well to the surface only when it is held open. When control is lost, the SSSV is an automatic closing valve preventing fluid flow for safety reasons. The SSSV 46 may be hydraulically controlled though it would be more advantageous for electrical control as this will reduce the size of the components. Such a reduction in the size of the components of the SSSV 46 will not affect the shut-in function which is the main feature of the SSSV.

The upper master valve 48 and the lower master valve 50 are ball valves or similar having dimensions which fit within the tubing 44 of the lower tree portion 24. While the width of the valve is restricted by this internal bore of the production casing string, the length and depth of the valve 48, 50 are unconstrained. The valves 48, 50 may be operated by any number of ways but must include a valve locking feature so that at least one may be pressurized from above. Such a valve locking feature can be achieved by the addition of balance line pressure manipulation, for example. Conversely if the upper and lower master valves 48, 50 are shallow then the balance line may be eliminated by the use of a high energy spring feature, pre-charged gas, or other energy storage mechanisms.

Figure 4:
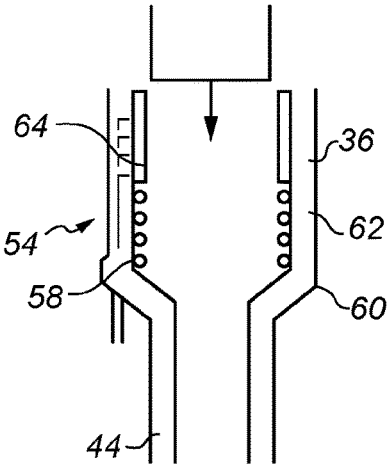
FIG. 4 is a schematic illustration of the upper part of the lower tree portion of FIG. 3 as in the Christmas tree of FIG. 1.
Figure 3:
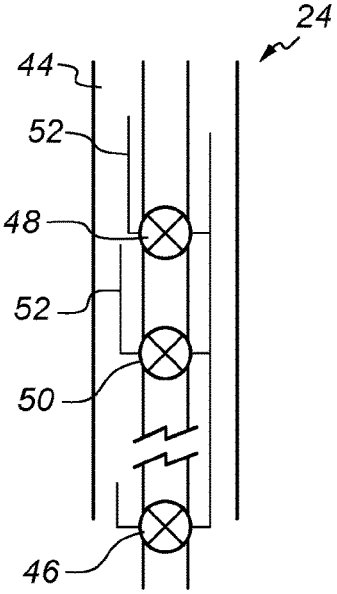
FIG. 3 is a schematic illustration of the lower part of a lower tree portion of the Christmas tree of FIG. 1.
Figure 7C:
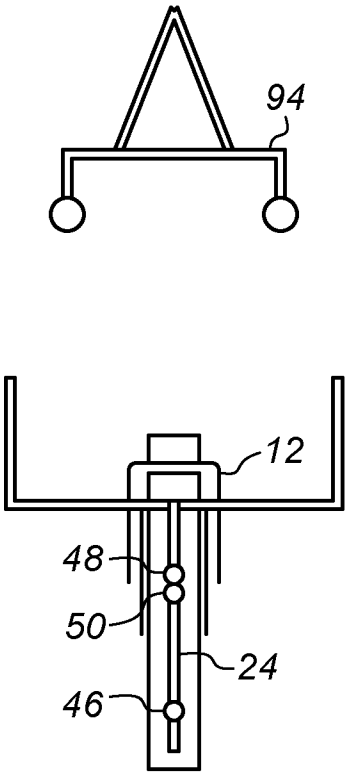
Figure 7B:
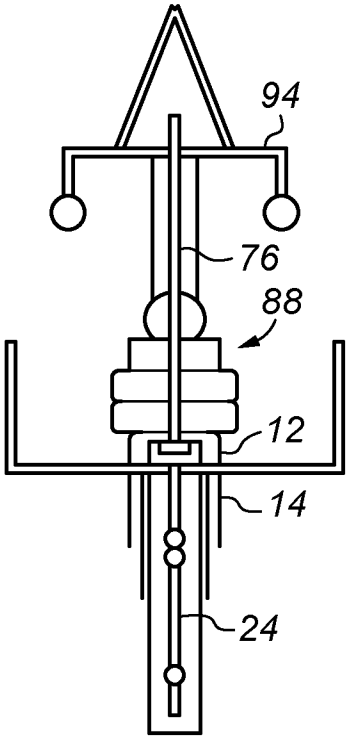
Figure 7A:
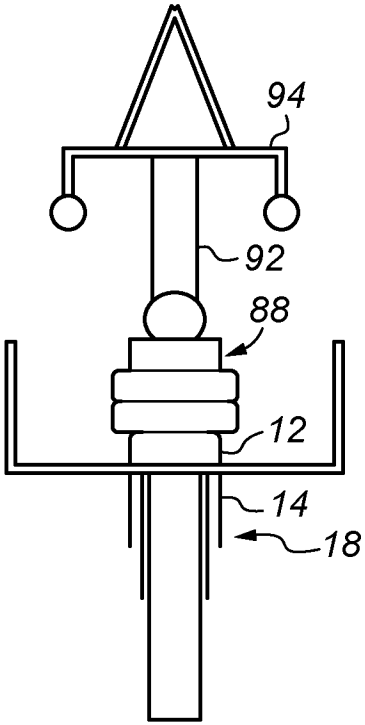
Figure 7F:
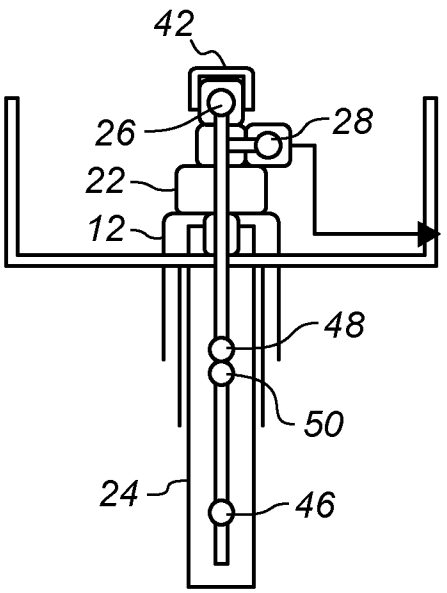
Figure 7E:
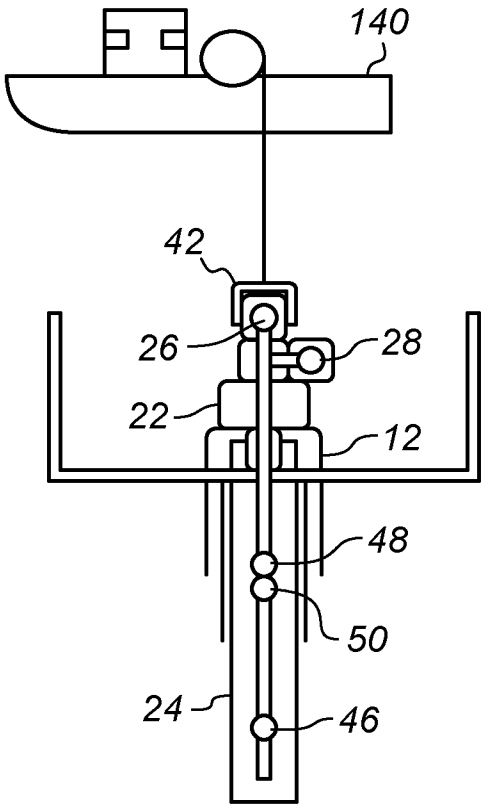
Figure 7D:
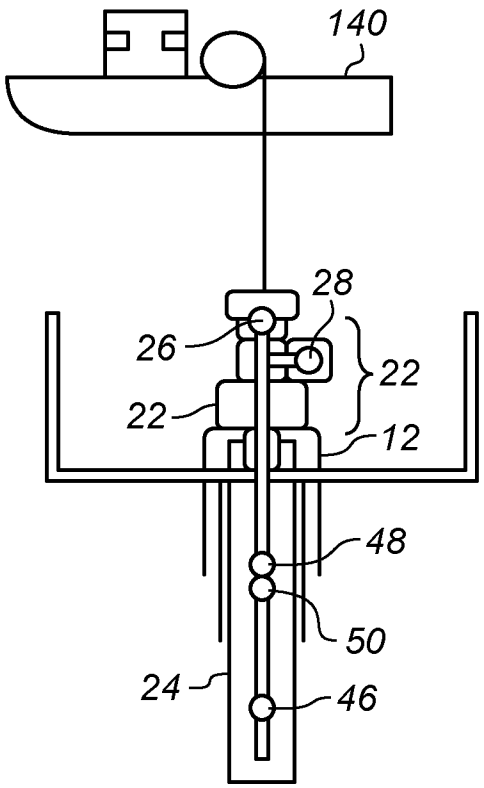

The upper end of the lower tree portion 24 comprises a tree interface 54 with engaging and coupling means to the upper tree portion 22. The tree interface 54 includes means to connect the outer surface of the lower tree portion 24 to the inner surface 58 of the tubing 44. In the illustration of a tree interface in FIG. 4, the connection is made via landing shoulder 60 located on the outer surface 56 of a widened upper section 62 of the interface 54. This widened upper section 62 accommodates the concentric stab 36 of the upper tree portion 22. The upper portion 62 is cylindrical in nature as is the stab 36. In this way, there are no orientation requirements for the stab to locate within the upper section 62. The upper section 62 presents a concentric seal bore 64 for the stab 36 to seal against. Also included in the tree interface 54 are connections to the upper tree portion 22 for the transfer of power, electrical, electro-hydraulic, hydraulic signals and monitoring signals between the two portions 22, 24. It will be apparent from FIG. 4 that the connection may be in the form of a tubing hanger 66 with the landing shoulder on the outer surface 56 at the upper section 62. The upper tree portion 22 will lock into a wellhead connector as is known in the art with the stab 36 locating within the interface tree 54. It is noted that in this arrangement, the connections are made directly between the upper tree portion and the lower tree portion and between the lower tree portion and the casing string 16. Unlike conventional subsea Christmas trees, which present a production bore and an off-axis annulus bore which must be orientated into alignment, the present invention provides a mono bore on a true axial arrangement. This makes the system easier to deploy as it does not require manipulation over the moonpool as for conventional Christmas trees.

The concentric stab 36 and concentric seal bore 64 provide an orientationless connection system. It will, however, be apparent to those skilled in the art, that the present invention may use the conventional eccentric annulus stab, if preferred.

Figure 5:
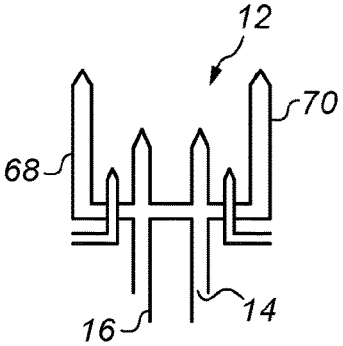
FIG. 5 is a guidebase convertor for location on the guidebase or for running with the upper tree portion of the Christmas tree of FIG. 1.

In the present invention, the wellhead 12 is considered to have an integrated permanent guidebase 68 as is illustrated in FIG. 5. The guidebase 68 is a frame including guide rods 70, typically four, which are equidistantly placed around the wellhead 12. An electrohydraulic control (stab) for the control module could be provided to the permanent guidebase as could a flow line for the exit of production fluid.

Figure 6:
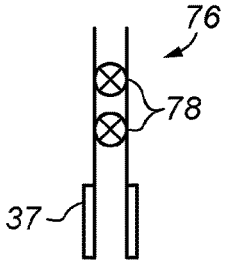
FIG. 6 is a schematic illustration of the lower end of a landing string suitable for running in the lower tree portion of the Christmas tree of FIG. 1.

In order to insert the lower tree portion 24 into the wellbore 18, there is provided a landing string 76. Landing string 76 is illustrated in FIG. 6. Landing string 76 is a work string which has a concentric stab 37 located at its lower end. Stab 37 is similar in formation to stab 36 found on the upper tree portion 22. In this way, the control handling available to the lower tree portion 24 when connected to the upper tree portion 22 is also available when the lower tree portion 24 is connected to the landing string 76. Thus, when the lower tree portion 22 is run into the wellbore 18, full control is available to the upper and lower master valves 48, 50 and the SSSV 46 as desired. In addition, a landing string may include its own secondary valves 78 which can be operated from the same control handling as that which is connected to the stab 37 and onto the lower tree portion 24 via the interface 54. The use of secondary valves 78 provides an additional safety barrier if required when the lower tree portion 24 is run in the wellbore 18 through the wellhead 12 and when the well is pressure tested against a master valve.

The landing string 76 will land the lower tree portion 24 with an upper portion in the wellhead or in the casing as described hereinbefore. The length of tubing of the lower tree portion 24, from the hang-off point to the master valves can be selected to both ensure the master valves 48, 50 are safely located deep in the well and that the distance between the master valves 48, 50 and the swab valve 26 is greater than a length of an intervention string.

In use, the tree 10 is deployed into a wellbore 18. This may be as part of a completion of a well. Referring now to FIGS. 7(*a*) to 7(*f*) there is illustrated the sequence of operations done to install the tree 10. At FIG. 7(*a*), a floating rig 94 is positioned over the wellhead 12. A riser 92 provides a conduit to the wellhead 12 at which is located a blow-out preventer (BOP) and annular preventer on an H4 connector of the wellhead 12. In this arrangement the well is drilled to depth, the wellhead with casing hanger/tubing hanger 17 is installed and all the well casings are installed and tested. This is a standard arrangement as known to those skilled in the art.

Next the completion and lower tree potion 24 is run with work string and running tool, being the landing string 76. FIG. 7(*b*) shows the landed and tested configuration in the wellhead 12 above the tubing hanger 17. In an embodiment, the landing string 76, as at FIG. 6, is stabbed into the interface 54 at the top of the lower tree portion 24, as at FIG. 4, so that the lower tree portion is hung from the landing string. The interface 54 is illustrated in FIG. 8.

FIG. 8 shows the lower portion of the landing string 76 with concentric stab 37 located in the concentric seal bore 64 of the lower tree portion 24. A protection sleeve 118 on the stab 36 is forced into the bore 64 to transmit movement by mechanical linkage between the string 76 and the tree portion 24. Multiple galleries 120 having radial seals 122 therebetween are aligned for separate control lines 124 to connect between the string 76 and a lower tree portion 24. These control lines will typically be electrical, signal, optical or hydraulic or may be a combination of all. The control lines 124 will pass along the outer surface 126 of the production tubing 84 to meet with the master valves 48, 50 for the control thereof. Power to the valves 48, 50 is provided via an inductive coupling or similar arrangement 128. Note that while there is no locking mechanism shown in FIG. 10, any appropriate locking system as is known in the art e.g. collets and locking could be used. With connection made at the interface the master valves 48,50 and SSSV 46 can be operated from surface during deployment. Secondary valves 78 in the landing string 76 provide additional well control through the tubing 84 during deployment. The landing string 76 will act as a running tool to position the upper end of the lower tree portion 24 in the wellhead housing 14 and the master valves 48,50 below the wellhead housing 14. As the lower tree portion 24 may be a monobore arrangement, the portion 24 can be run coaxially without any requirement for rotational orientation as there is no off-axis separate stab for connection to the annuli bores. These connections will be provided from the multiple galleried 120 arrangement of control lines 124. In this way, the lower tree portion 24 is easily deployed into a standard wellhead 12. The lower tree portion 24 is hung within the wellhead housing 14 via the tubing hanger 17 or may be landed on any shoulders located in the casing string. The completion and the lower tree portion 24 are run together. The well can now be tested by operating the master valves 48,50 and the SSSV 46 as would be done using tubing hanger plugs in the prior art. With the lower tree portion 24 in position, the landing string 76 can be disconnected and pulled out of the wellbore 18. This step is perfectly safe as the SSSV 46 and the master valves 48,50 can be left in a closed configuration providing the dual safety barriers required. Indeed this arrangement, with secondary valves 78 in the landing string 76, allows intervention work to be done on the well. Emergency disconnect is easily brought about by closing the master valves 48,50, removal of the landing string 76, now operating as a work string, and pulling above the BOP. This is a very simple, effective and fool proof operation, making the tree 10 very safe to work with. All operations are similar to those conducted during a well test and rig crews can operate the system.

Referring now to FIG. 7(*c*), the landing string is removed and the BOP 88 and riser 92 are pulled leaving the wellhead 12 ready to accept the upper tree 'flow control' package. At this point the rig 94 may be released as the upper package can be run on a wire or similar by a vessel of convenience.

FIG. 9 illustrates a lower tree portion 24 connected to a wellhead housing 14, according to an embodiment of the present invention. A portion of a wellhead 12 is shown having a wellhead housing 14 in which is located a tie-back casing hanger 108 including casing hanger 110. On the casing hanger 110 is hung the casing string 16 which extends into the wellbore 18. These components are as would be typically found at a wellhead 12 and in this way no modification is required to the standard wellhead arrangement for use with the Christmas tree 10 of the present invention. The lower tree portion 24 provides a main tubing 32 hanging therefrom but at a distance below the wellhead. Although illustrated at the wellhead in FIG. 9, the upper and lower master valves 48, 50 can be positioned at a great distance from the upper end 114 so that they lie below the wellhead housing 14. Lower in the main tubing 32 is also located the subsurface safety valve 46 and its position can be independent of the position of the upper and lower master valves 48, 50. The stab 36 of the landing string 76 is seen being removed from the wellbore 18. This illustrates the valves 48,50 having dimensions constrained by the casing inner diameter and the internal bore of the production tubing 84. However, the lengths and depths are unconstrained. These valves will be ball valves or other apparatus which can retain pressure which, as they are controlled via control lines 124, provide control to the SSSV 46 to maintain it's safety function. Of greater significance is the bidirectional sealing ability of the upper master valve 48. Unlike a check valve used in the SSSV 46, the master valve 48 can hold pressure from above, so that the master valve 48 can be closed and a pressure test achieved within the wellbore 18.

With the lower tree portion 24 in position, the upper tree portion 22 can be deployed. Referring to FIG. 7(*d*), a vessel of convenience e.g. boat is used to lower the upper tree portion 22 into position. A known running tool can be used to lower the upper tree portion into position, locking it to a wellhead connector and test the same against the wellhead and completion. With the upper tree portion 22 lowered in position and as it's concentric stab 36 is similar to that of the landing string 76, connection and the re-establishment of control of the valves 46,48,50 is readily achieved. The physical dimensions of the stab 36 are defined by the upper wellhead cavity (normally occupied by the tubing hanger) the casing inner diameter and the bore requirements of the production tubing 84. The length of the stab 36 is not constrained and may be as long as required within the casing inner diameter.

Referring now to FIG. 10, in this embodiment, the landing string 76 has been moved and in its place, is located the upper tree portion 22. The upper tree portion 22 includes a concentric stab 36 which locates and seals within the concentric seal bore 64 of the lower tree portion 24. The upper tree portion 22 will be locked onto the wellhead 12 by standard methods. The upper tree portion 22 provides a continuation of the main tubing 32 which in this embodiment shows the flow-in valve 28 and the swab valve 26 in the form of a crown plug. A control module 130 is also provided which will connect to the control lines 124. A debris cap 42 may be located over the swab valve 26 and this is illustrated in FIG. 7(*e*) being installed via the vessel of convenience.

It is noted that the insertion of the lower tree portion 24 and the upper tree portion 22 does not require any orientation with the monobore arrangement allowing ease of insertion. The multiple galleries 120 align with control fluid connections via the concentric arrangement around the main tubing 32. By using an electric, electrohydraulic, optical and/or electrical signal control system, the tree 10 is made narrow enough to locate within the existing wellhead 12.

Referring to FIG. 7(*f*) it is seen that the debris cap 42 is installed. The upper package/upper tree portion 22 has been tested and the vessel of convenience 140 has left. The production flow line and spoolpiece are shown hooked-up, which can be done by rig or other intervention vessel. It is also possible to have the flowbase prepared with the flowline and spoolpieces prior to the drilling operations.

A further feature of the present invention is in the provision of a guidebase converter for location upon the upper tree portion 22 for ease of connection of the flow lines. This is illustrated in FIG. 11. As is typically found at the wellhead 12, there is a permanent guidebase 68 which includes a set of guide rods 70 typically positioned equidistantly around the wellhead 12. The guidebase converter of the present invention 132 is landed on the permanent guidebase 68. The guidebase converter provides a low profile framework having downwardly facing funnels 133 at the locations of the guide rods 70. In this way, the low profile framework is easily positioned over and connects with the permanent guidebase 68. The low profile framework has interface hubs 137 for retro-fitting the flow line 74 and the electrohydraulic control line 72. This all facilitates future upper tree portion 22 replacement.

The present invention therefore creates a low profile tree system with a lower portion below the wellhead. This provides a flexible system and the dropping of a master valve further into the well has the advantages of: removing the requirement for tubing hanger plugs; hydrate prone wellheads are less likely to effect the lower placed valves; well integrity is significantly improved, especially for subsea where there is less risk from trawlers, icebergs or even ship's hulls in shallow water; significant reduction in wellhead height and reduced lever-arm with no exposed main tree valve actuators; the location of a safety barrier deep in the well improves safety, so that in the event of fire, the well can be shut with sufficient time for a platform or suchlike to be evacuated.

The present invention also provides advantages when intervention is required. Turning now to FIG. 12, there is illustrated initially at FIG. 12(*a*), a conventional arrangement for a completed subsea well in which a conventional subsea tree is used. In this arrangement, the tree 80 is located upon the seabed 82. The tree 80 will include the swab valve 26, flow wing valve 28 and a crossover valve 39. Additionally, above the surface of the sea bed 82, will also be arranged the upper master valve 48 and the lower master valve 50. The sub-surface safety valve 46 will be located deep in the wellbore 18. Production tubing 84 is then run through the wellbore 18 from the wellhead 12. This tree 80 will have been required to be orientated to sit within the wellhead housing 14 so that the production tubing 84 is coaxially arranged with an annular bore 86. Further valves connected to each annulus are not shown for clarity. Arranged directly above the tree 80, is a blow-out preventer 88, and an emergency disconnect system 90. The BOP 88 and emergency disconnect system 90 are used for intervention work and for the original landing of the completion for the wellbore 18. During this intervention work, there is a riser 92 connecting the subsea tree 80 to a rig 94 at sea level 96. Control for the tree 80 can be directed from sea level 96 via an upper well control system 98. FIG. 12(*a*) also illustrates a lubricator 100 being an intervention tool designed to allow running of wireline tools through the subsea tree 80 and access the wellbore 18.

Referring now to FIG. 12(*b*), there is illustrated a subsea well arrangement including the tree 10 of the present invention. In this arrangement the rig 94 at sea level 96 of the upper well control system 98 and the indicator 100 are as for that shown in FIG. 12(*a*). At the sea bed 82, the production tubing 84 is shown in a wellbore 18 with the subsurface safety valve 46 located low in the wellbore as for the arrangement in FIG. 12(*a*). The tree 10 is shown with the lower tree portion 24 located below the wellhead 12 such, that the upper and lower master valves 48, 50 lie below the sea bed 82 and in particular, below the wellhead housing 14. At the sea bed 82 is arranged the upper tree portion 22 including the swab valve, flow-in valve and crossover valve 26, 28, 39 respectively. This upper tree portion 22 is appreciably smaller in size than the conventional tree 80 of FIG. 12(*a*). The emergency disconnect 90 and the BOP 88 can be identical to that of FIG. 12(*a*) but now with the lower profile provided by the upper tree portion 22, the height above sea bed 82 is appreciably lower. This will provide an advantage in that trawler nets are less likely to snag on the subsea tree package when the riser 92, and rig 94, emergency disconnect 90 and intervention system 88 are moved away.

It can be seen that if the intervention tool string 101 is lowered through the riser 92, it could, in the arrangement of FIG. 12(*a*), straddle the BOP 88 and the tree 80. As subsea wells are vulnerable to the sticking of tool strings 101, then if the string 101 were to stick at a position straddling the tree 80 and the BOP 88, the emergency disconnect 90 cannot be performed as the well is not safe with only the subsurface safety valve 46 being a single safety barrier. It is known that a dual safety barrier is required before emergency disconnection can be performed. Thus, the prior art arrangement is vulnerable to leaving an unsafe well in the event of a tool string sticking. This is alleviated by the design of the tree 10 of the present invention as shown in FIG. 12(*b*). In this arrangement, were the intervention tool string 101 to stick in passage and straddle the BOP and the upper tree portion 22, it cannot straddle the lower tree portion 24 also. In this way, when sticking occurs, the valves 48, 50 of the lower tree portion 24 together with the subsurface safety valve 46 provide the multiple uncompromised, safety barriers required for an emergency disconnect 90 to be performed. Thus, this arrangement leaves the well in a safe position.

Two more advantages are seen when the tree 10 is used in a platform-style hook-up as illustrated in FIG. 13. FIG. 13(*a*) shows a standard platform hook-up with the BOP 88 lying above the pipe deck 102 and the BOP 88 connected via the riser 92 to the conventional tree 80. As illustrated, the conventional tree includes the swab valve 26, flow wing valve 28, and kill wing valve 30. These lie above the annulus valve 104 which give access to the A, B and C annuli in the wellbore. As illustrated the subsurface safety valve 46 is provided at a significant distance below the wellhead 12 where the tree 80 is located. Typically, the distance between the blow-out preventer 88 and the tree 80 is around 2 to 30 feet.

As is known in the art, a tool string 101 for intervention placed through the riser 92 can be of 30 feet or more in length and thus, may straddle both the blow-out preventer 88 and the tree 80. If a tool string 101 were to straddle the BOP 88 and the tree 80, this would result in well control problems as the subsurface safety valve 46 cannot be considered as a sufficient safety barrier in the wellbore 18.

Referring now to refer to FIG. 13(*b*) there is illustrated a similar platform-style hook-up but now including the tree 10, of the present invention. As for FIG. 13(*a*), the riser 92 connects a BOP 88 located above the pipe deck 102 to the top of the tree 10 at the swab valve 26. This connection will be at the upper tree portion 22 located at the wellhead 12 of the swab valve 26, kill wing valve 30 and flow wing valve 28. The lower tree portion 24 now locates the master valves 48,50 some 100 feet or more below the upper tree portion 22 with the subsurface safety valve 46 located in the production tubing 84 below the master valves 48,50.

It will be apparent in this arrangement that while a tool string 101 could straddle the BOP 88 and the upper tree portion 22 there will always be the use of the valves 48,50 of the lower tree portion 24 together with the subsurface safety valve 46, if required, to provide the sufficient dual safety barrier and maintain well control in the event of sticking of the tool string across the BOP 88 and swab valve 26. This ability to provide a Christmas tree with a swab valve 26 and the upper master valve 48 separated by a distance greater than 100 feet, or indeed where the BOP 88 is located above the upper tree portion 22 and the upper master valve 48 is separated from the BOP 88 by a distance greater than 100 feet, ensures that the well can always be maintained in a controlled position as the tool string is prevented from straddling all the available safety systems.

The corollary land well arrangement is shown in FIG. 14 where at FIG. 14(*a*) a conventional tree 80 is located at ground level 106 and the BOP 88 is located directly above the swab valve 26. A tool string 101 can again be located through the BOP 88 and the tree 80 so that it straddles both the BOP 88 and the tree 80 leaving only the subsurface safety valve 46 located below, in the production tubing 84, as the only safety barrier. Referring to FIG. 14(*b*), at ground level 106 there is now only the upper tree portion 22 which provides an identical connection to the BOP 88. The lower tree portion 24 is located a distance of at least 100 feet below the wellhead 12 which is at ground level 106 and thus, the tool string 101 is incapable of straddling both the BOP 88 and the tree 10 across the upper tree portion 22 and lower tree portion 24. A tool string straddling the BOP 88 and the upper tree portion 22 will still leave the valves 48, 50 of the lower tree portion 24, providing the sufficient dual safety barrier and control of the well.

Additionally, if a workover is required, the lower tree portion 24 can be arranged to close the master valves 48,50, such that the upper tree portion 22 can be safely removed without the requirement for tubing hanger plugs to be inserted, set, un-set and removed during the workover.

The principle advantage of the present invention is that it provides a Christmas tree having an upper portion and a lower portion where the lower portion can include a master valve which is bi-directionally sealing and can be located below the wellhead housing which removes the requirement for tubing hanger plugs during well completion.

A further advantage of at least one embodiment of the present invention is that it provides a Christmas tree on location at a wellhead which is a monobore arrangement with a concentric stab on an upper portion and a concentric seal bore on a lower portion which removes the requirement for the orientation alignment typically found in prior art Christmas trees.

A yet further advantage of at least one embodiment of the present invention is that it provides a Christmas tree wherein the valves are separated by a distance sufficient to ensure that a work string cannot straddle a BOP and the entire tree during intervention.

Modifications may be made to the invention herein-described when departing from the scope thereof, for example, while a landing shoulder is illustrated as the connection means between the lower tree portion and the casing string, it will be apparent that other connection means may be used. A hanger or packer may be used.

I claim:

1. A Christmas tree for location at a standard wellhead, the wellhead having a wellhead housing and a tubing hanger extending into a wellbore from the wellhead housing, the tree comprising:

an upper tree portion, including a swab valve, a flow wing valve and, at a lower end, being configured for connection in the wellhead;

a lower tree portion, including one or more master valves arranged in a tubing, and being configured for connection and locking to an inner surface of the wellbore above the tubing hanger, wherein:

the upper tree portion and the lower tree portion are configured to be coupled together; and an uppermost master valve of the one or more master valves is a bi-directionally sealing valve and the uppermost master valve is located below the tubing hanger.

2. A Christmas tree according to claim 1 wherein a distance between the swab valve and the uppermost master valve is greater than a length of an intervention tool string.

3. A Christmas tree according to claim 1 wherein a blow-out preventer (BOP) is located above the upper tree portion and a distance between the BOP and the uppermost master valve is greater than a length of an intervention tool string.

4. A Christmas tree according claim 1 wherein the upper tree portion includes, at the lower end, a concentric stab for connecting the upper tree portion to a concentric seal bore located in the wellbore and the lower tree portion includes, at an upper end, the concentric seal bore for connection to the upper tree portion.

5. A Christmas tree according claim 1 wherein the upper and lower tree portions are coupled together with a connection interface and the type of coupling is selected from a group comprising: mechanical, hydraulic, electrical signal, electrical power, electro-hydraulic, optical and inductive.

6. A Christmas tree according to claim 5 wherein the connection interface transfers electrical power.

7. A Christmas tree according to claim 5 wherein the connection interface transfers control signals.

8. A Christmas tree according to claim 5 wherein the connection interface transfers monitoring signals.

9. A Christmas tree according to claim 5 wherein the bidirectionally sealing valve is controlled from the upper tree portion.

10. A Christmas tree according to claim 5 wherein the bidirectionally sealing valve is controlled from a control module in the lower tree portion.

11. A Christmas tree according to claim 5 wherein the connection interface is orientationless.

12. Christmas tree according to claim 4 wherein the concentric seal bore is located in the wellhead.

13. A Christmas tree according to claim 1 wherein the lower tree portion is landed on a casing hanger in the wellhead.

14. A Christmas tree according to claim 4 wherein the concentric seal bore is located below the wellhead.

15. A Christmas tree according to claim 14 wherein a landing shoulder is provided on a casing string and the lower tree portion is landed on the landing shoulder.

16. A Christmas tree according claim 1 wherein at least one of the one or more master valves are designed to be wireline or coil-tubing cutting.

17. A Christmas tree according claim 1 wherein a control module is permanently plumbed into the upper tree portion.

18. A Christmas tree according claim 1 wherein a choke system is permanently plumbed into the upper tree portion.

19. A method of completing a well comprising the steps:

(a) providing a Christmas tree comprising: an upper tree portion, including a swab valve, a flow wing valve and, at a lower end, being configured for connection in a wellhead; a lower tree portion, including one or more master valves arranged in a tubing, and being configured for connection and locking to an inner surface of a wellbore, wherein an uppermost master valve of the one or more master valves is a bi-directionally sealing valve;

(b) providing a workstring, the workstring including a running stab at a lower end thereof;

(c) locating the running stab in the lower tree portion;

(d) running the lower tree portion into the well through a blow-out preventer (BOP);

(e) attaching the lower tree portion to the inner surface of the wellbore above a tubing hanger extending from the wellhead so that the uppermost master valve is located below the tubing;

(f) pressure testing against the uppermost master valve in the lower tree portion to determine well safety;

(g) pulling the workstring and the BOP; and (h) landing the upper tree portion on the wellhead and coupling the upper and lower tree portions together.

* * * * *